US010900643B2

(12) United States Patent
Harpenau et al.

(10) Patent No.: US 10,900,643 B2
(45) Date of Patent: Jan. 26, 2021

(54) TRIM REMOVAL SYSTEM

(71) Applicant: SIGNIFY HOLDING B.V., Eindhoven (NL)

(72) Inventors: Kevin R. Harpenau, Portland, OR (US); Zhihong Lin, Shanghai (CN); Xiaolei Zhang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/397,182

(22) Filed: Apr. 29, 2019

(65) Prior Publication Data

US 2020/0340646 A1 Oct. 29, 2020

(51) Int. Cl.
*F21V 17/16* (2006.01)
*F21S 8/02* (2006.01)

(52) U.S. Cl.
CPC ..... *F21V 17/164* (2013.01); *F21S 8/026* (2013.01)

(58) Field of Classification Search
CPC ..... F21V 17/164; F21S 8/026
See application file for complete search history.

(56) References Cited

U.S. PATENT DOCUMENTS 9,599,315 B1 3/2017 Harpenau et al.
2017/0119249 A1* 5/2017 Gunn ..... A61B 3/125
2018/0372284 A1* 12/2018 Danesh ..... F21S 9/022

* cited by examiner

*Primary Examiner* — Joseph L Williams
*Assistant Examiner* — Jacob R Stern
(74) *Attorney, Agent, or Firm* — Patrick T. Driscoll

(57) ABSTRACT

A trim assembly includes a rimless trim, a reflector coupled to the rimless trim, and an optical lens disposed on the reflector. Further, the trim assembly includes a lens holder having pressure tabs formed on an inner surface thereof. The lens holder is disposed in the trim assembly such that the pressure tabs engage the optical lens to releasably seal the optical lens to the reflector for preventing entry of water. The lens holder stretches sideways to release the seal and at least partially separate the optical lens form the reflector when a force is applied on the optical lens. The partial separation between the optical lens and the reflector exposes a surface of the reflector that provides a grip to remove the trim assembly comprising the rimless trim from a mounting surface when the trim assembly is recess mounted in a mounting surface.

19 Claims, 10 Drawing Sheets

TRIM REMOVAL SYSTEM

TECHNICAL FIELD

Embodiments of this disclosure relate generally to luminaires, and more particularly, to a trim removal system for removing recess mounted rimless trims of recessed luminaires from mounting surfaces.

BACKGROUND

Rimless trims (also known as 'flangeless trims') are used with recessed luminaires to provide a clean, aesthetic, and high-end appearance where the trims are flush with the mounting surface (e.g., ceiling) in which they are installed. However, once the rimless trims are recess mounted in the mounting surface, the rimless trims may not be readily removable from the mounting surface because the rimless trims do not offer any convenient surface to grasp and/or pull out the rimless trims from the mounting surface. That is, since the outer diameter of a recess mounted rimless trim is recessed into the mounting surface and the rimless trim does not have any feature (e.g., a flange) that extends out from the ceiling for grasping, removing the rimless trim from the mounting surface may be challenging.

An existing solution to remove a recess mounted rimless trim from a mounting surface includes fixedly coupling a lens of the recessed luminaire to the trim, providing a suction cup that a user can attach to the lens, and pulling the trim out by pulling the lens using the suction cup. However, said existing solution may cause damage to the lens and/or may require the user to carry additional specialized equipment (i.e., the suction cup) which may be inconvenient. Another existing solution to remove the recess mounted rimless trim from the mounting surface includes floating the lens, i.e., not securing the lens to the trim or coupling the lens to the trim such that a user can easily push the lens up without any resistance to reveal any appropriate surface of the trim or recessed luminaire on which the user can grasp to pull the trim out. However, said existing solution may not provide a water tight installation. That is, said recessed luminaire installation with a rimless trim where the lens is floated above the trim may not meet a UL wet rating standard, which in turn limits the environments in which the recessed luminaire can be used.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure relates to a trim assembly that includes a rimless trim, a reflector that is coupled to the rimless trim, a lens that is disposed on the reflector, and a trim removal system. The trim removal system includes a lens holder. The lens holder includes a pressure tab disposed on an inner surface thereof. The lens holder is disposed in the trim assembly such that: the pressure tab of the lens holder engages the lens to hold the lens against the reflector, and when a force is applied to the lens in a direction opposite the rimless trim, the pressure tab causes the lens holder to stretch outward to separate the lens from the reflector.

In another aspect, the present disclosure relates to a luminaire. The luminaire includes a trim assembly that is configured to be recess mounted in a mounting surface such that the trim assembly is flush with the mounting surface. The trim assembly includes a rimless trim, a reflector that is coupled to the rimless trim, a lens disposed on the reflector, a lens holder comprising a pressure tab disposed on an inner surface thereof. Further, the luminaire includes a shield that is coupled to the rimless trim such that: the lens holder, the lens, and the reflector are securely held between the shield and the rimless trim, and the pressure tab of the lens holder engages lens to releasably seal the lens to the reflector.

These and other aspects, features, and embodiments of the present invention may be more clearly understood and appreciated from a review of the following detailed description of the disclosed embodiments and by reference to the drawings and the claims.

BRIEF DESCRIPTION OF THE FIGURES

Embodiments are illustrated by way of example and not limitation in the figures of the accompanying drawings, in which.

Figure 1:
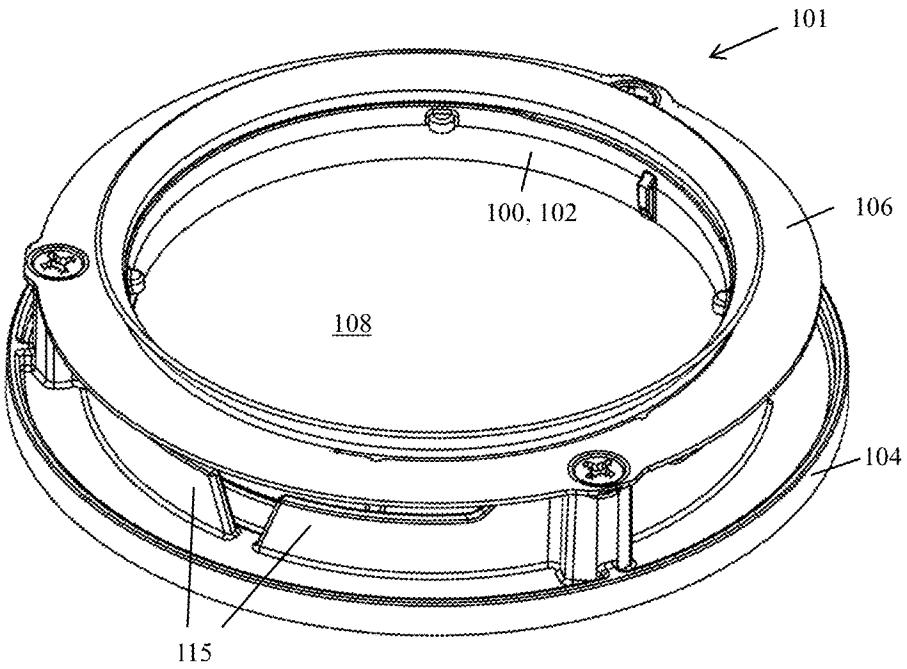
FIGS. 1 and 2 illustrate top and bottom perspective views of a trim assembly comprising a first example trim removal system, in accordance with an example embodiment.

The drawings illustrate only example embodiments of the present disclosure and are therefore not to be considered limiting of its scope, as the present disclosure may admit to other equally effective embodiments. The elements and features shown in the drawings are not necessarily to scale, emphasis is instead placed on clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes a trim removal system that is configured to enable a rimless trim of a recessed luminaire that has been recess mounted in a mounting surface to be removed from the mounting surface (e.g., a ceiling). The trim removal system of the present disclosure may be configured to meet a UL wet rating standard, while also allowing the rimless trim of the recessed luminaire to be removed from a mounting surface without having to use any specialized equipment.

An example trim removal system of the present disclosure includes a lens holder that has pressure tabs. The lens holder is disposed in an example trim assembly that comprises a rimless trim, a reflector that is coupled to the rimless trim, and a lens that is disposed on and coupled to the reflector. The lens holder is disposed in the trim assembly such that the pressure tabs of the lens holder apply pressure on the lens to releasably seal the lens against the reflector. The releasable seal prevents water, moisture, or any other environmental elements from entering the recessed luminaire or trim assembly through the interface between the lens and the reflector, while also allowing the lens to be at least partially separated from the reflector by releasing the seal therebetween to remove the rimless trim from a mounting surface. The lens is at least partially separated from the reflector by applying a force on the lens, the force being opposite to the pressure applied by the pressure tabs of the lens holder. The at least partial separation between the lens and reflector exposes a surface of the reflector (e.g., an edge) that the user can grasp to pull down the reflector and thereby remove the rimless trim of the trim assembly that is coupled to the reflector.

Upon applying the force, the lens holder may stretch horizontally or sideways. That is, the lens holder stretches substantially perpendicular to a central axis of the lens holder. Further, once the force is released and the lens is pushed down in the opposite direction, the lens holder reverts to its default state (non-stretched state) where the pressure tabs of the lens holder apply pressure on the lens to releasably seal the lens to the reflector.

The trim removal system will be described in further detail by way of examples with reference to the attached drawings. In the description, well-known components, methods, and/or processing techniques are omitted or are briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

For any figure shown and described herein, one or more of the components may be omitted, added, repeated, and/or substituted. Accordingly, embodiments shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

The term 'releasably seal' as used herein may generally refer to securely holding a lens against a reflector in a manner that is not permanent. That is, when the lens is securely held against the reflector, an interface between the reflector and the lens may be closed to prevent ingress of any environmental elements such as water, moisture, etc. However, said interface can be opened upon application of a force to separate the lens from the reflector at least partially.

Turning now to the figures, example embodiments of a trim removal system will be described in association with FIGS. 1-10. In particular, an example trim removal system of the present disclosure will be described in connection with FIGS. 1-8; and another example trim removal system of the present disclosure will be described in connection with FIGS. 9-10 by referring to FIGS. 1-8 as needed.

Figure 2:
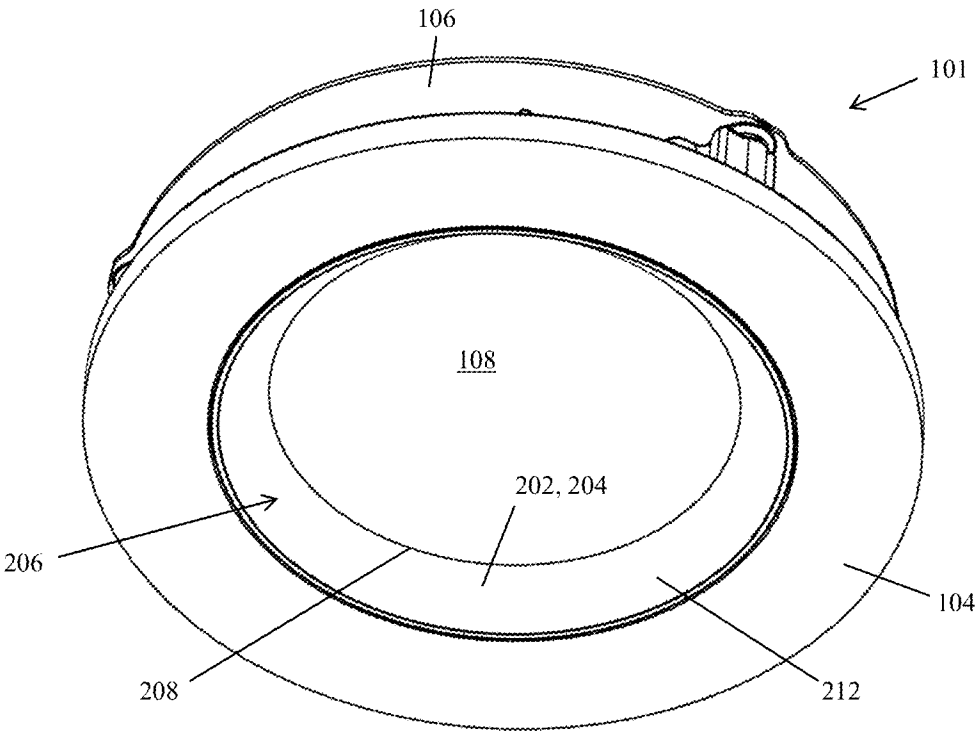
Figure 3:
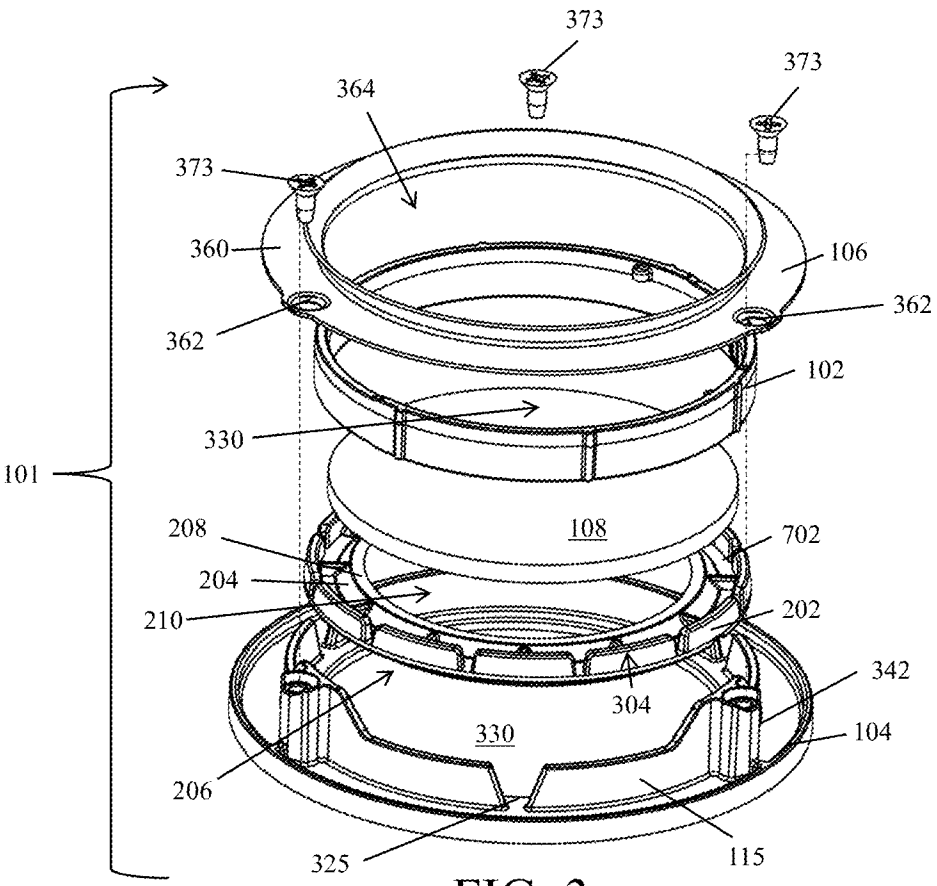
FIG. 3 illustrates an exploded view of the trim assembly of FIG. 1, in accordance with an example embodiment.
Figure 4:
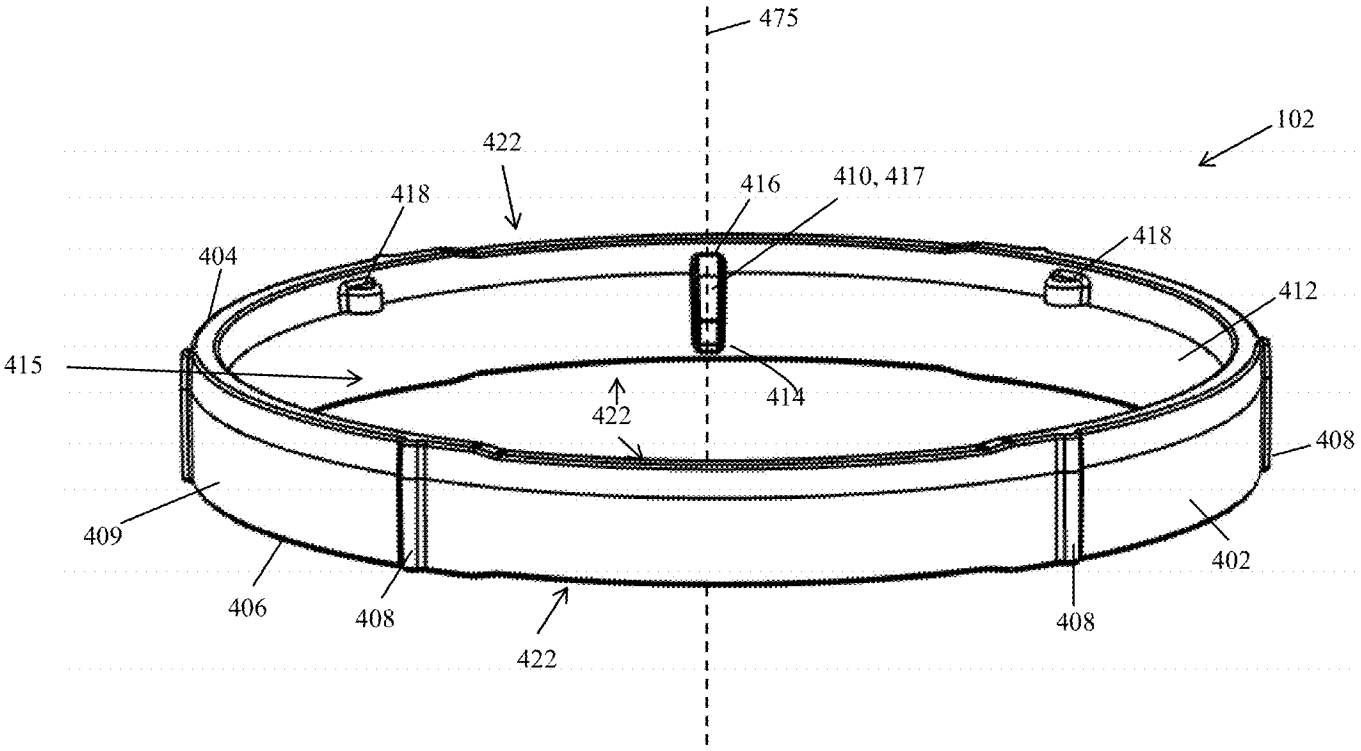
FIG. 4 illustrates a perspective view of the first example trim removal system of FIG. 1, in accordance with an example embodiment.
Figure 7:
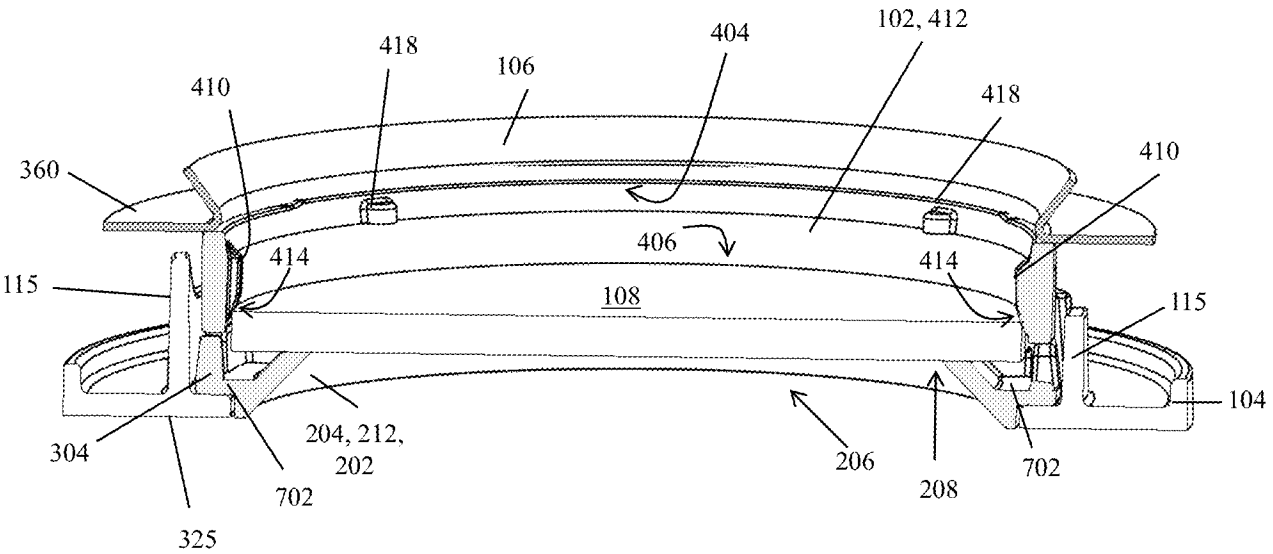
FIG. 7 illustrates a cross-section view of a trim assembly of FIG. 1, in accordance with an example embodiment.
Figure 8:
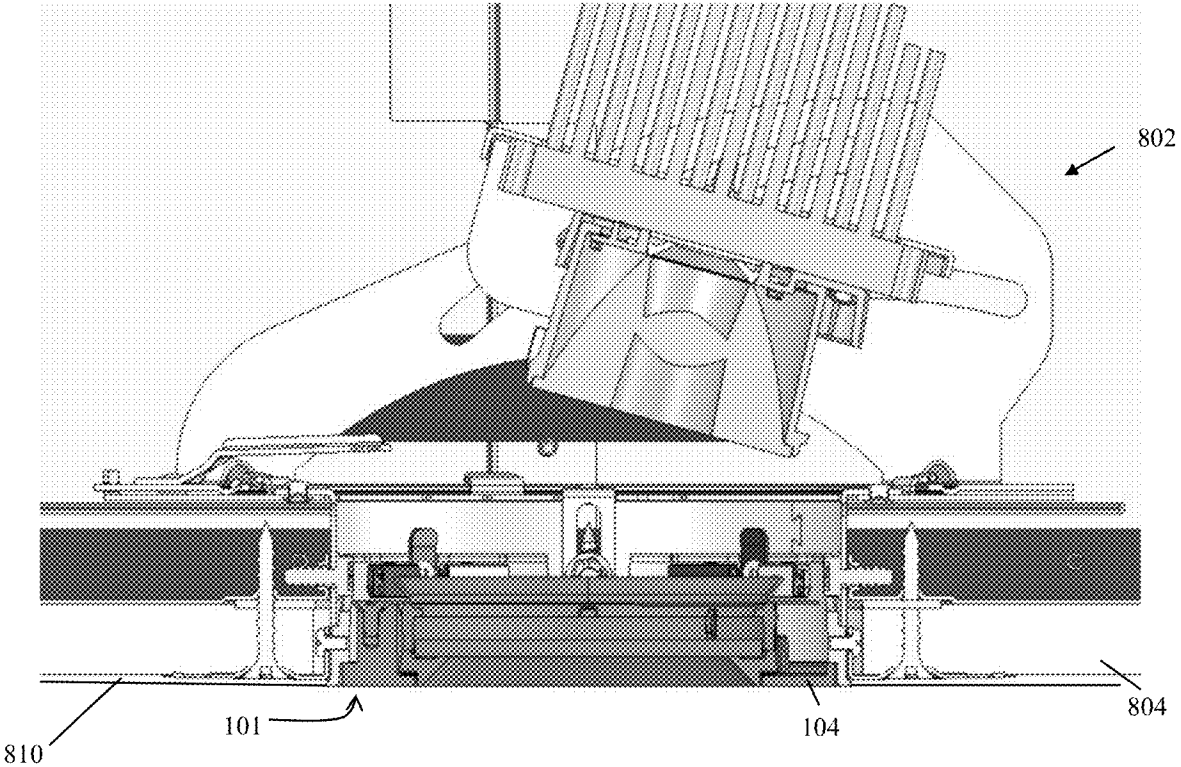
FIG. 8 illustrates a cross-section view of a recessed luminaire that is disposed in a mounting surface with the trim assembly of FIG. 1, in accordance with an example embodiment.

Referring to FIGS. 1-8, an example trim removal system 100 may include a lens holder 102 that is disposed in a trim assembly 101. As illustrated in FIG. 3, the example trim assembly 101 may include a rimless trim 104, and a shield 106 that is coupled to the rimless trim 104. The shield 106 may be configured to conceal one or more features of a recessed luminaire 802 (shown in FIG. 8). For example, the shield 106 may be configured to conceal one or more electronic components and/or fasteners (e.g., screws) in the recessed luminaire 802 for improved aesthetics. As illustrated in FIG. 8, the trim assembly 101 may be disposed or recess mounted in the mounting surface 804 such that the rimless trim 104 of the trim assembly 101 is flush with the mounting surface 804 (with the finishing plate 810 applied thereto).

In addition to the shield 106 and the rimless trim 104, the trim assembly 101 may include the lens holder 102, an optical lens 108, and a reflector 202 as illustrated in FIG. 3. The reflector 202 may include an annular base 702, an outer support wall 304 that extends substantially perpendicular to the base 702 from an outer perimeter of the base 702, and an inner reflector wall 204 that extends angularly from an inner perimeter of the base 702 that defines a light emitting opening 206 as illustrated in FIGS. 2, 3, and 7. The inner reflector wall 204 may extend from the inner perimeter of the base 702 to a top inner edge 208 that defines a light receiving opening 210. The inner reflector wall 204 tapers from the inner perimeter of the base 702 to the top inner edge 208. However, in other example embodiments, the inner reflector wall 204 may taper from the top inner edge 208 to the inner perimeter of the base 702 such that the light emitting opening 206 is narrower than the light receiving opening 210. Further, the inner surface 212 of the inner reflector wall 204 may be coated with reflective material or the inner reflector wall 204 may be formed using reflective material. In some example embodiments, the inner surface 212 of the inner reflector wall 204 may be smooth, however, in other example embodiments, the inner surface 212 may be baffled. The reflector 202 may be configured to receive light emitted from a light source of the recessed luminaire 802 through the light receiving opening 210 and direct the light towards the light emitting opening 206 using the reflective inner surface 212 thereof. The light exits the reflector 202 (and the trim assembly 101) via the light emitting opening 206 thereof.

As illustrated in FIGS. 4-7, the lens holder 102 may include a body 402 that is substantially cylindrical. The body 402 may extend from a top edge 404 to a bottom edge 406 and may define a central through opening 415 (herein 'central opening 415'). The lens holder 102 may include pressure tabs 410 that are formed on the inner surface 412 of the body 402. The pressure tabs 410 may extend radially inward from the inner surface 412 of the body 402 towards the central opening 415. Each pressure tab 410 may be disposed between the top edge 404 and the bottom edge 406 and may be substantially curved. In particular, each pressure tab 410 may include a bottom surface 414 that is disposed adjacent the bottom edge 406 of the body 402, a top surface 416 disposed adjacent the top edge 404, and a middle surface 417 that is disposed between the top surface 416 and the bottom surface 414. The bottom surface 414 of each pressure tab 410 may have a slope that extends into the central opening 415 and towards the central axis 475 of the lens holder 102 as the bottom surface 414 progresses from adjacent the bottom edge 406 towards the top edge 404. As such, the bottom surface 414 defines an obtuse angle 491 with the inner surface 412 of the body 402. The top surface 414 of each pressure tab 410 may have a slope that extends into the central opening 415 and towards the central axis 475 as the top surface 414 progresses from adjacent the top edge 404 of the body 402 towards the bottom edge 406. As such, the top surface 414 defines an obtuse angle 492 with the inner surface 412 of the body 402. In addition to the pressure tabs 410, the lens holder 104 may include stop tabs 418 that are disposed on the inner surface 412 of the body 402 adjacent the top edge 404 thereof. The stop tabs 418 may be disposed between adjacent pressure tabs 410.

Figure 5:
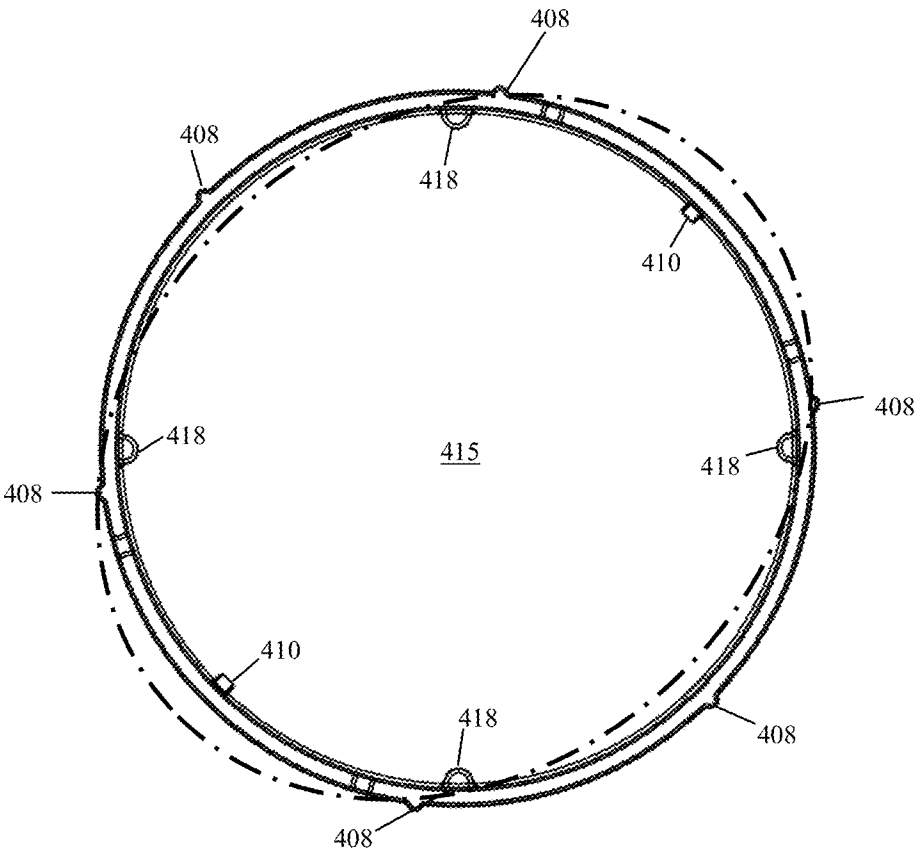
FIG. 5 illustrates a top view of a first example trim removal system of FIG. 1, in accordance with an example embodiment.
Figure 6:
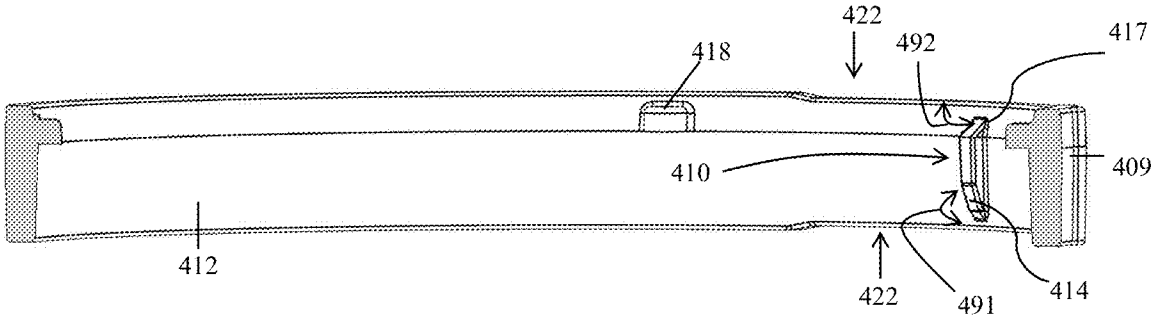
FIG. 6 illustrates a cross-section view of a first example trim removal system of FIG. 1, in accordance with an example embodiment.

Further, as illustrated in FIGS. 4-7, the lens holder 102 may include a plurality of ribs 408 that are disposed on an outer surface 409 of the body 402 and that extend radially outward therefrom. The ribs 408 are configured to align the lens holder 102 within the trim assembly 101 such that the lens holder 102 is centered within the trim assembly 101 (or particularly within the inner sidewall 115 of the rimless trim 104). The ribs 408 may not be disposed on the outer surface 408 that is adjacent or opposite to the pressure tabs 410 to allow the lens holder 102 to flex or stretch outwards in the areas where the pressure tabs 410 are located as illustrated in FIG. 5 (stretched or flexed state shown using dotted lines). Although the example embodiments described herein show two pressure tabs, it should be understood that alternate embodiments can have one pressure tab or more than two pressure tabs. Additionally, in some example embodiments, notches 422 may be formed on the top edge 404 and the bottom edge 406 adjacent the pressure tabs 410 such that adjacent the pressure tabs 410, a height of the lens holder 102 measured from the top edge 404 to the bottom edge 406 may be lesser than a remainder portion of the lens holder 102. The notches 422 and the resulting reduced height of the lens holder 102 adjacent the pressure tabs 410 may allow the lens holder 102 to flex outward in the areas where the pressure tabs 410 are located with minimal resistance (e.g., from friction with other components disposed above and below the lens holder 102) as will be described below in greater detail.

Figure 9:
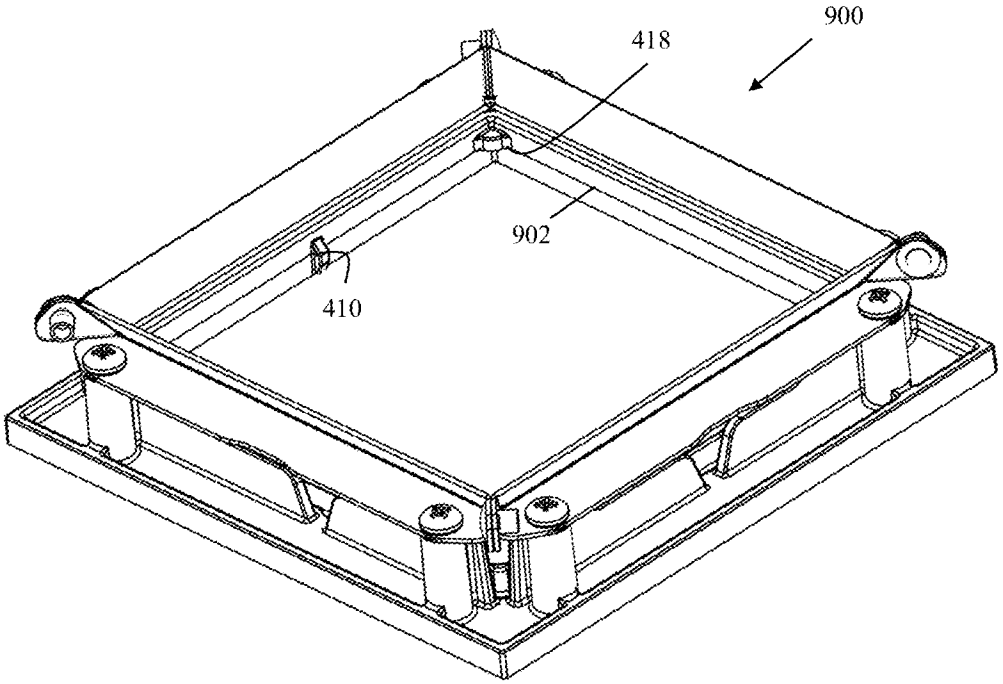
FIG. 9 illustrates a perspective view of a trim assembly comprising a second example trim removal system, in accordance with an example embodiment.
Figure 10:
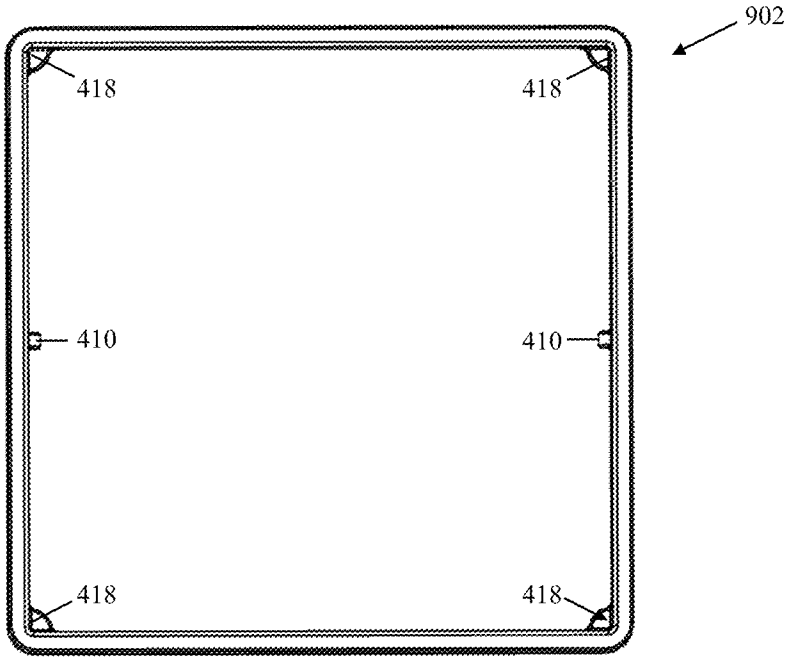
FIG. 10 illustrates a top view of the second example trim removal system of FIG. 9, in accordance with an example embodiment.

Even though the present disclosure describes the lens holder as being substantially cylindrical in shape, one of skill in the art can understand and appreciate that in some example embodiments, the lens holder may have any other appropriate shape without departing from a broader scope of the present disclosure. The shape of the lens holder may depend on the shape of the trim assembly in which the lens holder is disposed. For example, as illustrated in FIGS. 9 and 10, the trim assembly 900 and the lens holder 902 that is disposed therein may have a square profile. Further, even though the present disclosure describes that the lens holder 102 includes ribs that are disposed on the outer surface thereof, one of skill in the art can understand and appreciate that in other example embodiments, the lens holder may not include any ribs. Furthermore, even though the present disclosure describes that the lens holder has notches formed on the top edge and the bottom edge adjacent the pressure tabs, one of skill in the art can understand and appreciate that in other example embodiments, the lens holder may not have said notches. That is, in other example embodiments, the height of the lens holder measured from the top edge to the bottom edge may be uniform throughout the body of the lens holder.

As illustrated in FIGS. 1-3 and 7-8, the trim assembly 101 may be arranged such that the lens holder 102, the optical lens 108, and the reflector 202 are disposed and securely held between the shield 106 and the rimless trim 104. In an example arrangement of the trim assembly 101, as illustrated in FIG. 7, the reflector 202 may be coupled to the rimless trim 104 and disposed in the trim assembly 101 such that by pulling down the reflector 202, the rimless trim 104 and/or the trim assembly 101 may be removed from the mounting surface 804. As illustrated in FIG. 7, the annular base 702 of the reflector 202 may be disposed on an inner shoulder 325 of the rimless trim 104 that extends into a central through cavity 330 defined by the rimless trim 104 such that: (a) the reflector 202 is disposed within the central through cavity 330 defined by the rimless trim 104, (b) outer support wall 304 of the reflector 202 is disposed within the inner sidewall 115 of the rimless trim 104, and (c) the reflector 202 rests and is supported on the shoulder 325 of the rimless trim 104. Further, the optical lens 108 may be disposed on the reflector 202 such that the optical lens 108 rests on the top inner edge 208 of the inner reflector wall 204 of the reflector 202 and covers the light receiving opening 210 of the reflector 202. Furthermore, the lens holder 102 may be disposed on the reflector 212 such that: (a) the bottom edge 406 of the lens holder 102 rests and is supported on the outer support wall 304 of the reflector 202, (b) the lens holder 102 is disposed within the central through cavity 330, and (b) the bottom surface 414 of the pressure tabs 410 of the lens holder 102 engages a portion of the optical lens 108.

Additionally, a flange 360 of the shield 106 may be disposed on the top edge 404 of the lens holder 102 such that: (a) coupling apertures 362 of the shield 106 may be aligned with the respective screw bosses 342 of the rimless trim 104, and (b) a central aperture 364 defined by the shield 106 may be axially aligned with the central through opening 415 of the lens holder 102 and the central through cavity 330 of the rimless trim 104. Then, fasteners 373 may be extended through the aligned coupling apertures 362 of the shield 106 and the screw bosses 342 of the rimless trim 104 to couple the shield 106 to the rimless trim 106 and securely retain the lens holder 102, the optical lens 108, and the reflector 202 in between the shield 106 and the rimless trim 104. In some example embodiments, as the fasteners 373 are tightened, i.e., when the shield 106 is coupled to the rimless trim 104, the pressure tabs 410 that engage the optical lens 108 may apply a pressure or a force on the optical lens 108 that releasably seals the optical lens 108 to the top inner edge 208 of the reflector 202 that defines the light receiving opening 210. The seal prevents water or other environmental elements from entering the recessed luminaire 802 and/or the trim assembly 101 beyond the point of contact or interface between the optical lens 108 and the top inner edge 208 of the reflector 202 when the trim assembly 101 is installed in a wet location, such as a shower room, for example.

In other words, the lens holder 102, the optical lens 108, and the reflector 202 may be disposed between the shield 106 and the rimless trim 104 such that: (a) the optical lens 108 rests on the reflector 202, and (b) the pressure tabs 410 of the lens holder 102 engage the optical lens 108 and apply pressure thereon to create a releasable seal between the optical lens 108 and the reflector 202. The releasable seal between the optical lens 108 and the reflector 202 may allow: (a) the trim assembly 101 and the recessed luminaire 802 with which the trim assembly 101 is used to meet UL wet rating standards and/or requirements, and (b) the rimless trim 104 of the trim assembly 101 to be removed from the mounting surface 804 in which it is installed when said seal is released and the optical lens 108 is at least partially separated from the reflector 202.

To remove the rimless trim 104 from the mounting surface 804, a user may release the seal formed between the optical lens 108 and the reflector 202 by pushing on the optical lens 108 in a direction opposite to the pressure applied by the pressure tabs 410 of the lens holder 102. As the user pushes and applies a force on the optical lens 108, the optical lens 108 may travel along the slope of the bottom surface 410 of at least one of the pressure tabs 410, which in turn may apply an upward force and an outward force on the pressure tabs 410 of the lens holder 102. The application of the outward force on the pressure tabs 410 may cause the lens holder 102 to flex outward as illustrated in FIG. 5. That is, when an upward force (i.e., towards the top edge 404 of the lens holder 102) is applied on the bottom surface 414 of the pressure tabs 410 of the lens holder 102 that is disposed in the trim assembly 101, the lens holder 102 may not move upward because the lens holder 102 is securely and tightly held between the rimless trim 104 and the shield 106 which prevent the upward movement of the lens holder 102. Instead, the lens holder 102 may flex or stretch sideways, i.e., in a direction that is substantially perpendicular to the direction in which the optical lens is pushed or substantially perpendicular to a central axis 475 of the lens holder 102.

The lens holder 102 may be disposed in the trim assembly 101 such that sufficient space is provided within the trim assembly 101 for the lens holder 102 to stretch sideways. The sideways stretching or flexing of the lens holder 102 as illustrated in FIG. 5 allows the optical lens 108 to travel along the slope of the lens holder's bottom surface 414 and consequently move upwards to release the seal formed with the reflector 202 and separate from at least a portion of the reflector 202. When the seal between the optical lens 108 and the reflector 202 is released and the optical lens 108 separates from at least a portion of the reflector 202, an appropriate surface of the reflector 202 (e.g., the top inner annular edge 208 or the surface that forms a seal with the optical lens) may be exposed. The surface of the reflector 202 that is exposed (e.g., the top inner edge 208) because of the separation from the optical lens 108 may provide a location for the user to grasp and pull the reflector 202 and consequently the trim assembly 101 comprising the rimless trim 104 out of the mounting surface 804. In some example embodiments, the user may grasp the exposed surface of the reflector 202 using the user's fingers, however, in other example embodiments, the user may use other tools such as the head of a screw driver, etc.

Once the force that is applied on the lens to at least partially separate the optical lens 108 from the reflector 202 is released, the lens holder 102 may revert to its default state in which the pressure tabs 410 of the lens holder 102 apply a pressure on the optical lens 108 to releasably seal the optical lens 108 against the reflector 202.

The stop tabs 418 on the lens holder 102 may be configured to prevent any further movement of the optical lens 108 beyond the stop tabs 418 of the lens holder 102 in case the force that is applied on the optical lens 108 stretches the lens holder 102 to an extent that the optical lens 108 passes over the pressure tabs 410 towards the top edge 404 of the lens holder 102. Also, the stop tabs 418 prevents the optical lens 108 from falling out of the trim assembly 101 if the trim assembly is inverted or held upside down (shield 106 facing the ground).

Although the disclosure refers to example embodiments, it should be appreciated by those skilled in the art that various modifications are well within the scope of the disclosure. From the foregoing, it will be appreciated that an embodiment of the disclosure overcomes the limitations of the prior art. Those skilled in the art will appreciate that the disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of this disclosure will suggest themselves to practitioners of the art. Therefore, the scope of this disclosure is not limited herein.

What is claimed is:

1. A luminaire comprising:
- a rimless trim;
- a reflector coupled to the rimless trim;
- a lens disposed on the reflector; and
- a lens holder comprising a pressure tab disposed on an inner surface thereof,
- wherein
  - the pressure tab of the lens holder engages the lens to hold the lens against the reflector, and
  - when a force is applied to the lens in a direction away from the rimless trim, the pressure tab causes the lens holder to stretch outward to separate the lens from the reflector.

2. The luminaire of claim 1, wherein when the lens is separated from the reflector, a surface of the reflector is exposed to permit grasping of the reflector to remove the rimless trim, the lens, and the reflector from a mounting surface.

3. The luminaire of claim 2, wherein the mounting surface is a ceiling.

4. The luminaire of claim 1, further comprising a shield that is coupled to the rimless trim such that the lens holder, the lens, and the reflector are securely held between the shield and the rimless trim.

5. The luminaire of claim 1, wherein the lens holder comprises a plurality of ribs that extend radially outward from an outer surface of the lens holder, wherein the plurality of ribs are configured to align the lens holder within the luminaire.

6. The luminaire of claim 1, wherein the lens holder comprises stop tabs that extend radially inward from the inner surface.

7. The luminaire of claim 6, wherein the lens holder extends from a top edge to a bottom edge, and wherein the stop tabs are disposed adjacent the top edge and the pressure tab is disposed adjacent the bottom edge.

8. The luminaire of claim 1, wherein the pressure tab is contoured such that a surface of the pressure tab that engages the lens extends toward a central axis of the lens holder.

9. The luminaire of claim 1, wherein the lens holder is substantially cylindrical in shape and defines a central cavity.

10. The luminaire of claim 1, wherein the lens holder is formed using flexible material.

11. The luminaire of claim 1, wherein the lens holder comprises a notch formed at a top edge and a bottom edge thereof adjacent the pressure tab.

12. A luminaire comprising:
- a trim assembly that is configured to be recess mounted in a mounting surface such that the trim assembly is flush with the mounting surface, wherein the trim assembly comprises:
- a rimless trim;
  - a reflector coupled to the rimless trim;
  - a lens disposed on the reflector; and
  - a lens holder comprising a pressure tab disposed on an inner surface thereof; and a shield that is coupled to the rimless trim such that:

the lens holder, the lens, and the reflector are securely held between the shield and the rimless trim, the pressure tab of the lens holder engages the lens to create a releasable seal between the lens and the reflector; and wherein the lens holder is configured to stretch outward to separate the lens from the reflector when a force is applied to the lens in a direction away from the rimless trim.

13. The luminaire of claim 12, wherein the releasable seal between the lens and the reflector prevents water from entering the trim assembly and the luminaire between the lens and the reflector.

14. The luminaire of claim 12, wherein the lens holder comprises stop tabs that are disposed adjacent a top edge of the lens holder, and wherein the inner surface of the lens holder defines a through cavity.

15. The luminaire of claim 12, wherein the lens holder comprises a notch formed at a top edge and a bottom edge thereof adjacent the pressure tab.

16. The luminaire of claim 12, wherein the lens holder comprises two pressure tabs that are disposed opposite to each other.

17. The luminaire of claim 12, wherein when the lens is separated from the reflector, a surface of the reflector is exposed to permit grasping of the reflector to remove the trim assembly from the mounting surface.

18. The luminaire of claim 12, wherein the lens holder comprises a plurality of ribs that extend radially outward from an outer surface of the lens holder, wherein the plurality of ribs are configured to align the lens holder within the trim assembly.

19. The luminaire of claim 12, wherein the pressure tab is contoured such that a surface of the pressure tab that engages the lens extends toward a central axis of the lens holder.

* * * * *